US007090205B2

(12) United States Patent
Oda et al.

(10) Patent No.: US 7,090,205 B2
(45) Date of Patent: Aug. 15, 2006

(54) PREMIXED AIR-FUEL MIXTURE SUPPLY DEVICE

(75) Inventors: Takeo Oda, Kobe (JP); Hiroyuki Ninomiya, Akashi (JP); Masayoshi Kobayashi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 116 days.

(21) Appl. No.: 10/768,078

(22) Filed: Feb. 2, 2004

(65) Prior Publication Data

US 2005/0127537 A1 Jun. 16, 2005

(30) Foreign Application Priority Data

Dec. 16, 2003 (JP) ..... 2003-418728

(51) Int. Cl.
*F02M 19/03* (2006.01)

(52) U.S. Cl. ..... 261/78.1; 60/737; 261/79.1; 261/DIG. 55

(58) Field of Classification Search ..... 261/78.1, 261/78.2, 79.1, 79.2, DIG. 55; 60/737
See application file for complete search history.

(56) References Cited

U.S. PATENT DOCUMENTS

| | | | | | |
|---|---|---|---|---|---|
| 391,865 | A | * | 10/1888 | Schutte | 239/400 |
| 903,736 | A | * | 11/1908 | Lee | 239/400 |
| 1,777,141 | A | * | 9/1930 | Howden | 239/419 |
| 3,336,017 | A | * | 8/1967 | Kopa | 261/128 |
| 3,395,899 | A | * | 8/1968 | Kopa | 261/22 |
| 3,512,359 | A | * | 5/1970 | Pierce | 60/748 |
| 3,570,242 | A | * | 3/1971 | Leonardi et al. | 60/737 |
| 3,605,405 | A | * | 9/1971 | Du Bell | 60/737 |
| 3,618,317 | A | * | 11/1971 | Du Bell | 60/737 |
| 3,915,387 | A | * | 10/1975 | Caruel et al. | 239/400 |
| 3,937,011 | A | * | 2/1976 | Caruel et al. | 60/737 |
| 3,974,646 | A | * | 8/1976 | Markowski et al. | 60/737 |
| 4,198,815 | A | * | 4/1980 | Bobo et al. | 60/737 |
| 4,584,834 | A | * | 4/1986 | Koshoffer et al. | 60/737 |
| 4,726,182 | A | * | 2/1988 | Barbier et al. | 60/39.23 |
| 5,201,181 | A | * | 4/1993 | Ohmori et al. | 60/737 |
| 5,256,352 | A | * | 10/1993 | Snyder et al. | 261/78.2 |
| 5,359,847 | A | * | 11/1994 | Pillsbury et al. | 60/39.463 |
| 6,070,411 | A | * | 6/2000 | Iwai et al. | 60/737 |
| 6,363,725 | B1 | * | 4/2002 | Mei et al. | 60/737 |
| 6,655,145 | B1 | * | 12/2003 | Boardman | 60/737 |
| 6,834,505 | B1 | * | 12/2004 | Al-Roub et al. | 60/737 |
| 2003/0014975 | A1 | * | 1/2003 | Nishida et al. | 60/737 |
| 2003/0014976 | A1 | * | 1/2003 | Mandai et al. | 60/737 |
| 2003/0089111 | A1 | * | 5/2003 | Benelli et al. | 60/737 |
| 2004/0003596 | A1 | * | 1/2004 | Chin et al. | 60/737 |

FOREIGN PATENT DOCUMENTS

| | | | | |
|---|---|---|---|---|
| JP | 2-183720 | * | 7/1990 | 60/737 |
| JP | A 8-42851 | | 2/1996 | |
| JP | A 9-145057 | | 6/1997 | |
| JP | A 2002-206744 | | 7/2002 | |

* cited by examiner

*Primary Examiner*—Richard L. Chiesa
(74) *Attorney, Agent, or Firm*—Oliff & Berridge PLC

(57) ABSTRACT

A premixed air-fuel mixture supply device, combined with a combustor liner included in a combustor, includes a prevaporizing, premixing unit having inner and outer walls defining a prevaporizing, premixing chamber, and a wall surrounding an end part of the outer wall so as to define a secondary combustion air passage together with the end part of the outer wall around the prevaporizing, premixing chamber. A tail part of the outer wall is shaped in an atomization lip. The extremity of the tail part of the atomization lip is formed in a sharp edge or is cut perpendicularly or substantially perpendicularly to the flowing direction of the combustion air.

14 Claims, 3 Drawing Sheets

PREMIXED AIR-FUEL MIXTURE SUPPLY DEVICE

BACKGROUND OF THE INVENTION

1. Field of the Invention

The present invention relates to a premixed air-fuel mixture supply device for supplying a premixed air-fuel mixture to a combustor for a gas turbine or an aircraft engine and, more particularly, to a premixed air-fuel mixture supply device for supplying a premixed air-fuel mixture to a combustor to make the combustor combust a premixed air-fuel mixture in a lean-burn mode, reduce $NO_x$ and prevent the deterioration of combustion while the combustor is in a low-load operation.

2. Description of the Related Art

A conventional combustor for a gas turbine or an aircraft engine has a combustor casing, and a cylindrical or annular combustor liner disposed in the combustor casing to define a combustion chamber. A fuel nozzle is connected to a head part of the combustor liner. The combustor casing and the combustor liner define an air passage through which air supplied by an air compressor flows into the combustion chamber.

When fuel is injected in air for diffusive combustion in the combustion chamber of this combustor of a gas turbine or an aircraft engine, high-temperature regions are formed locally in the combustion gas, and the high-temperature regions increases the concentration of $NO_x$ in the combustion gas.

Interest in environmental problems has progressively increased in recent years and restrictions on environmental condition have been intensified. The inlet temperature of recent gas turbines and aircraft engines, namely, the outlet temperature of the combustors of gas turbines and aircraft engines, has been raised to improve the thermal efficiency of the gas turbines and aircraft engines. However, the local high-temperature regions in the combustion gas produced by diffusive combustion increase and the concentration of $NO_x$ increases accordingly as the outlet temperature of the combustors of gas turbines and such increases. Therefore, measures for reducing $NO_x$ is very important.

A gas turbine combustor with a lean premixed, prevaporized combustion system (a prevaporized, premixed air-fuel mixture lean-burn type combustor for a gas turbine) is proposed to reduce the concentration of $NO_x$ in the combustion gas. In this gas turbine combustor, fuel is supplied at a substantially fixed rate in a pilot combustion region on the upstream side of a combustion chamber to produce high-temperature combustion gas by stable combustion, a lean air-fuel mixture is burned in a main combustion region below the pilot combustion region for lean-burn combustion that scarcely produces $NO_x$. When a liquid fuel is vaporized beforehand to produce a prevaporized, premixed air-fuel mixture for lean burn.

Referring to FIG. 3 showing a conventional combustor, compressed air supplied by an air compressor, not shown, flows through a space between a combustor casing 1 and a combustor liner 2. When the combustor is a forward flow combustor, air flows in the direction of the blank arrow (→), and the right end, namely, the downstream end, of the combustor casing 1 is closed. When the combustor is a backward flow combustor, air flows in the direction of the arrow (←), and the left end, namely, the downstream end, of the combustor casing is closed. Combustion air reached the combustor head flows into a pilot combustion air passage 3 and a main combustion air passage 4. Although the main combustion air passage 4 shown in FIG. 3 is divided into two air passages 4*a* and 4*b*, the main combustion air passage 4 does not necessarily need to be divided.

Referring to FIG. 4 showing a premixing air-fuel mixture supply device, pilot fuel is injected out through fuel injection holes 5*a* formed in a pilot fuel injection nozzle 5 and arranged at angular intervals. Swirl devices 6*a* and 6*b* for swirling combustion air are disposed above the fuel injection holes 5*a*. Main fuel is injected out through main fuel injection holes 7 arranged at angular intervals. Swirl devices 8*a* and 8*b* for swirling combustion air are disposed above the main fuel injection holes 7. An atomization lip 9 extends downstream from the swirl devices 8*a* and 8*b* to atomize the main fuel. A prevaporizing, premixing chamber 10 is supplied into a combustion chamber 15 below the premixing air-fuel mixture supply device. The premixed air-fuel mixture burns in the combustion chamber 15.

Related techniques are disclosed in JP-A 8-42851, JP-A 9-145057 and JP-A 2002-206744.

The following problems arise when this previously proposed prevaporized, premixed air-fuel mixture lean-burn type combustor uses both the pilot fuel and the premixed air-fuel mixture while the combustor is in a low-load operation. The fuel injected by the premixed air-fuel mixture supply device is unable to vaporize in the prevaporizing, premixing chamber because the temperature of air around the fuel is comparatively low, unvaporized fuel drops mixed in the swirling air are caused to adhere to a wall defining the prevaporizing, premixing chamber by centrifugal force and the fuel cannot be satisfactorily atomized and vaporized. Consequently, the quality of combustion of the premixed air-fuel mixture in the combustion chamber is deteriorated.

While the prevaporized, premixed air-fuel mixture lean-burn type combustor is in a high-load operation, the quality of combustion in the combustion chamber is not deteriorated because the temperature around the injected fuel is sufficiently high, and fuel droplets are vaporized substantially completely before reaching the wall defining the prevaporizing, premixing chamber.

SUMMARY OF THE INVENTION

The present invention has been made to solve those problems in the prior art and it is therefore an object of the present invention to provide a premixed air-fuel mixture supply device for a gas turbine or an aircraft engine, capable of improving combustion in the combustor of the gas turbine or the aircraft engine.

According to the present invention, a premixed air-fuel mixture supply device combined with a combustor liner included in a combustor comprises: a prevaporizing, premixing unit having inner and outer walls defining a prevaporizing, premixing chamber; and a wall surrounding an end part of the outer wall so as to define a secondary combustion air passage together with the end part of the outer wall around the prevaporizing, premixing chamber; wherein a tail part of the outer wall is shaped in an atomization lip.

The premixed air-fuel mixture supply device according to the present invention further comprises a swirl device disposed in the secondary combustion air passage.

In the premixed air-fuel mixture supply device according to the present invention, the atomization lip is formed such that a tail part thereof lies at or near the exit of the prevaporizing, premixing chamber.

In the premixed air-fuel mixture supply device according to the present invention, the extremity of the tail part of the atomization lip is formed in a sharp edge.

In the premixed air-fuel mixture supply device according to the present invention, the extremity of the tail part of the atomization lip is cut perpendicularly or substantially perpendicularly to the flowing direction of the combustion air.

In the premixed air-fuel mixture supply device according to the present invention the extremity of the tail part of the atomization lip is cut perpendicularly or substantially perpendicularly to the flowing direction of the combustion air, and the extremity of the tail part of the atomization lip has a thickness between 1 to 3 mm.

In the premixed air-fuel mixture supply device according to the present invention, the secondary combustion air passage is formed around the prevaporizing, premixing chamber, and the sectional area of the secondary combustion air passage is 5% or below of the total sectional area of the prevaporizing, premixing chamber and the secondary combustion air passage.

In the premixed air-fuel mixture supply device according to the present invention, the secondary air passage is formed around the prevaporizing, premixing chamber, and the sectional area of the secondary combustion air passage is 5 to 10% of the total sectional area of the prevaporizing, premixing chamber and the secondary combustion air passage.

In the premixed air-fuel mixture supply device according to the present invention, the secondary air passage is formed around the prevaporizing, premixing chamber, and the thickness of the atomization lip formed in the tail part of the inner wall defining the secondary combustion air passage decreases in the flowing direction of combustion air so that the inside diameter of the atomization lip increases gradually in the flowing direction of combustion air.

In the premixed air-fuel mixture supply device according to the present invention, the secondary combustion air passage is formed around the prevaporizing, premixing chamber, and the thickness of the atomization lip formed in the tail part of the inner wall defining the secondary combustion air passage decreases in the flowing direction of combustion air so that the outside diameter of the atomization lip decreases gradually in the flowing direction of the combustion air.

In the premixed air-fuel mixture supply device according to the present invention, the secondary air passage is formed around the prevaporizing, premixing chamber, the swirling device disposed in the secondary combustion air passage swirls combustion air flowing through the secondary combustion air passage in one direction, and swirling devices disposed in an inner passage swirl combustion air flowing through the inner passage in the same direction.

In the premixed air-fuel mixture supply device according to the present invention, the secondary air passage is formed around the prevaporizing, premixing chamber, the swirling device disposed in the secondary air passage swirls combustion air flowing through the secondary air passage to swirl in one direction, and swirling devices disposed in an inner passage swirl combustion air flowing through the inner passage in a direction opposite the direction in which the swirling device disposed in the secondary combustion air passage swirls combustion air flowing through the secondary air passage.

In the premixed air-fuel mixture supply device according to the present invention, the prevaporizing, premixing unit injects the fuel in a direction substantially the same as the flowing direction of combustion air.

In the premixed air-fuel mixture supply device according to the present invention, the secondary combustion air passage is formed around the prevaporizing, premixing chamber, and the velocity of combustion air at the exit of the secondary combustion air passage is equal to or not lower than the velocity of air flowing through the inner passage.

Generally, main fuel injected while the combustor is in a low-load operation takes longer time for evaporation than that injected while the combustor is in a high-load operation because the temperature of combustion air into which the main fuel is injected is comparatively low while the combustor is in the low-load operation. Consequently, fuel droplets mixed in the swirling combustion air reach the outer wall of the prevaporizing, premixing chamber, adhere to the outer wall in a liquid film, adversely affecting the atomization of the fuel at the exit of the prevaporizing, premixing chamber.

The premixed air-fuel mixture supply device of the present invention has the secondary air passage formed around the prevaporizing, premixing chamber, and the atomization lip formed in the tail part of the inner wall of the secondary air passage. Therefore, the fuel spread in a liquid film over the outer wall of the prevaporizing, premixing chamber can be atomized at the edge of the atomization lip by air flowing along the outer and the inner surface of the atomization lip, so that the deterioration of combustion in the combustor can be prevented.

BRIEF DESCRIPTION OF THE DRAWINGS

The above and other objects, features and advantages of the present invention will become more apparent from the following description made in connection with the accompanying drawings, in which.

DESCRIPTION OF THE PREFERRED EMBODIMENTS

Figure 1:
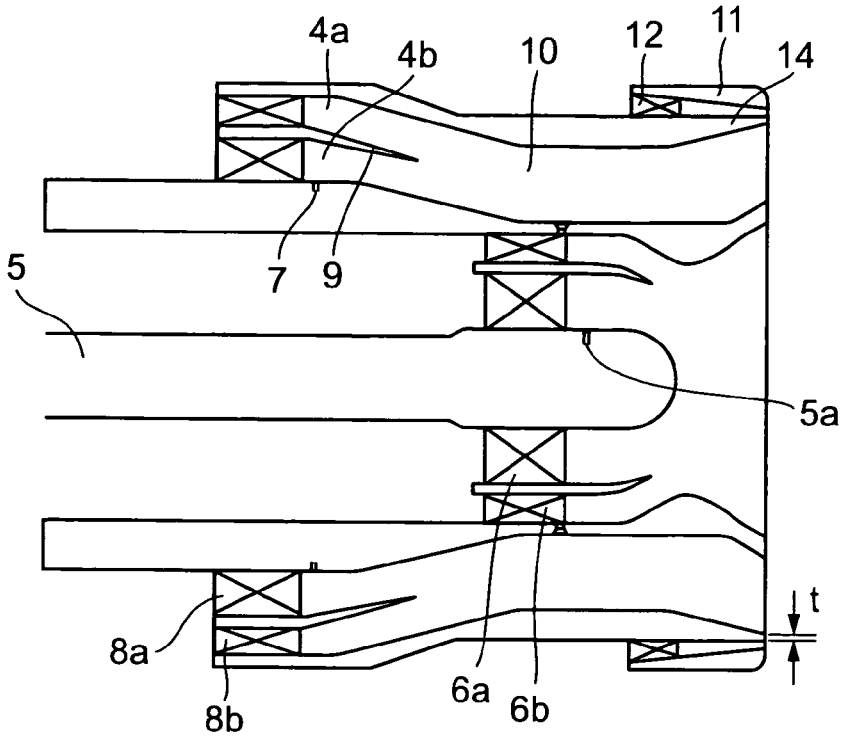
FIG. 1 is a schematic, longitudinal sectional view of a premixed air-fuel mixture supply device in a first embodiment according to the present invention.
Figure 2:
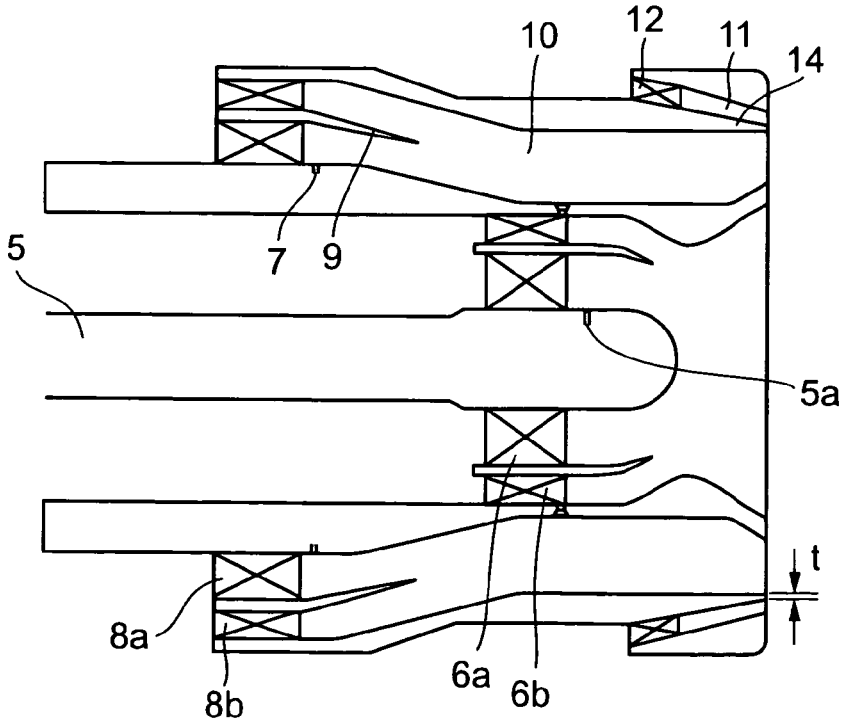
FIG. 2 is a schematic longitudinal sectional view of a premixed air-fuel mixture supply device in a second embodiment according to the present invention.
Figure 3:
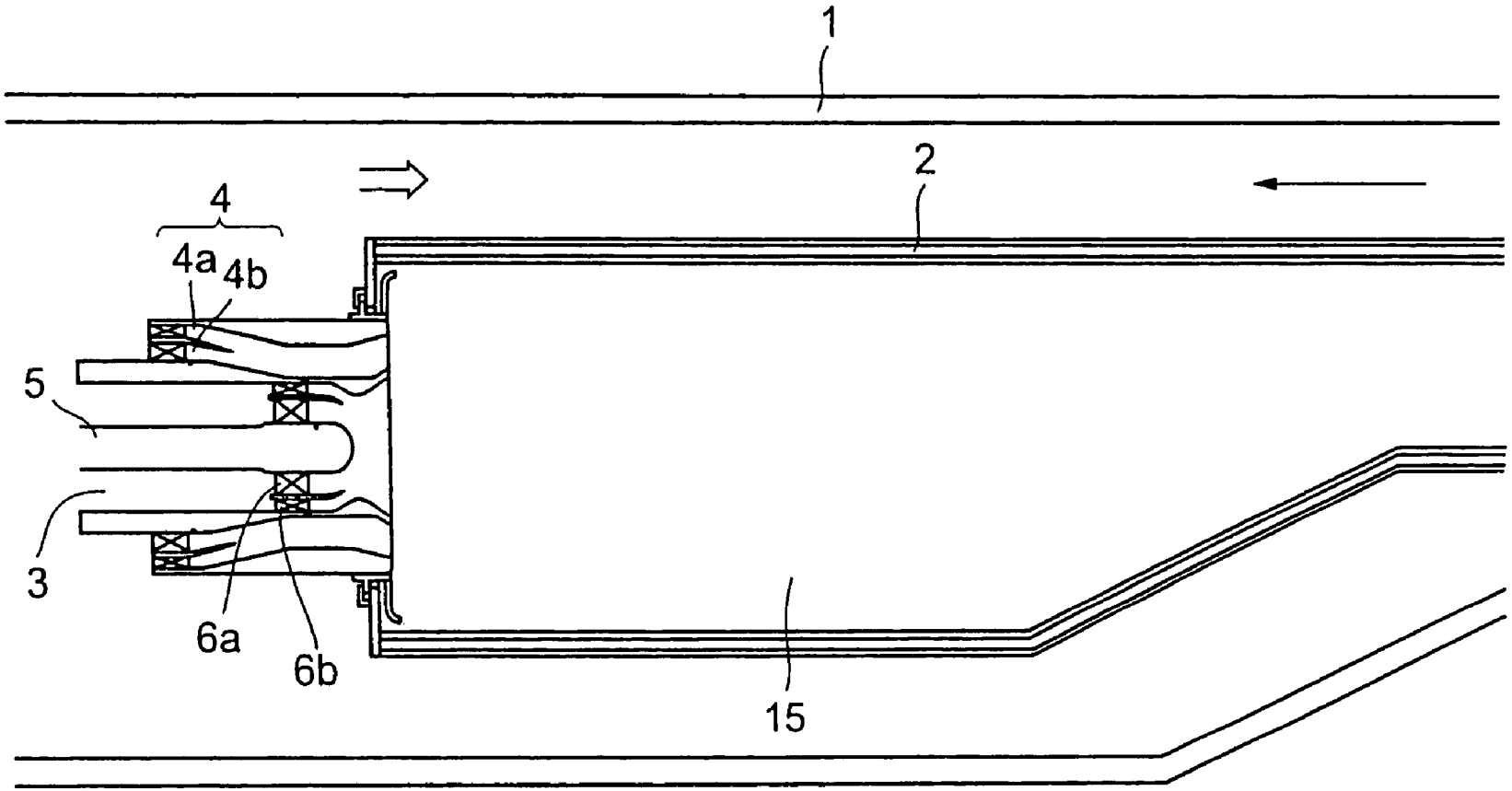
FIG. 3 PRIOR ART
FIG. 3 a schematic longitudinal sectional view of a conventional combustor.

FIGS. 1 and 2 show premixed air-fuel mixture supply devices in first and second embodiments, respectively. The premixed air-fuel mixture supply devices in the first and the second embodiment are substantially the same in construction.

Figure 4:
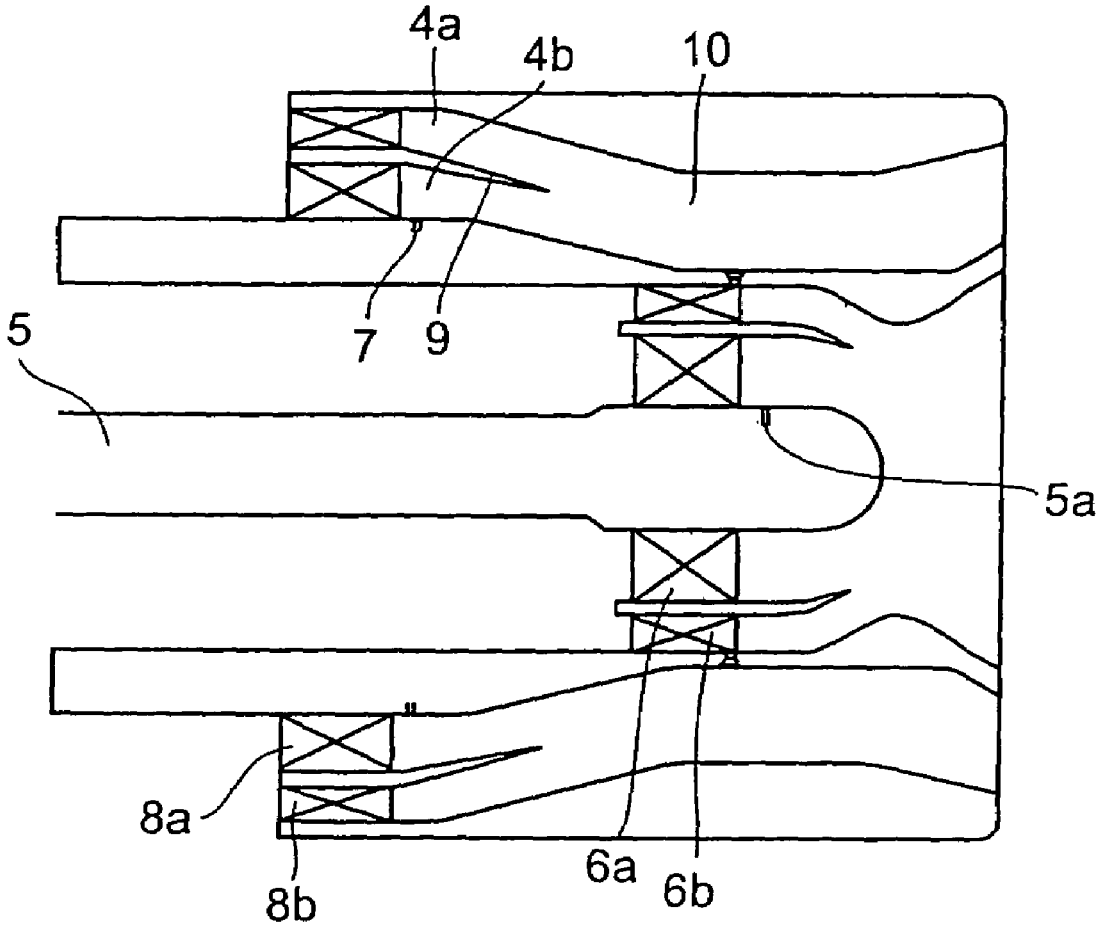
FIG. 4 PRIOR ART
FIG. 4 is schematic longitudinal sectional view of a premixed air-fuel mixture supply device included in the combustor shown in FIG. 3.

Referring to FIG. 1, the premixed air-fuel mixture supply device in the first embodiment, a pilot fuel injection unit is similar to the conventional fuel injection unit, and a main fuel injection unit is similar to that shown in FIG. 4. A secondary air passage 11 is formed around a prevaporizing, premixing chamber 10. A swirling device 12 for producing swirling air currents is disposed in the secondary air passage 11. The thickness of a tail part of an outer wall defining the prevaporizing, premixing chamber 10 is decreased toward a combustion chamber, not shown, to form a downstream atomization lip 14 having an inside diameter gradually increasing toward the combustion chamber.

In the premixed air-fuel supply device in the second embodiment shown in FIG. 2, a tail part of an outer wall defining a prevaporizing, premixing chamber 10 is decreased toward a combustion chamber, not shown, to form a downstream atomization lip 14 having an outside diameter gradually decreasing toward the combustor.

Only the premixed air-fuel mixture supply device in the first embodiment will be described because the premixed air-fuel mixture supply devices in the first and second embodiment are substantially the same in construction.

Main fuel is injected through main fuel injecting holes 7 into air currents flowing through an air passage 4*b* in directions substantially perpendicular to the flowing direction of the air currents. Such a mode of injecting the main fuel is not restrictive, and the main fuel does not necessarily need to be injected substantially perpendicularly to the flowing direction of the air currents. For example, the main fuel may be injected upstream or may be injected downstream. When main fuel is injected from an intermediate wall between swirling devices 8*a* and 8*b* shown in FIG. 1, it is preferable to inject the main fuel in a direction parallel to the surface of an upstream atomization lip 9. The main fuel injecting holes 7 are arranged at angular intervals.

Part of the injected main fuel impinges on the inner surface of the upstream atomization lip 9, flows downstream in a liquid film along the inner surface of the upstream atomization lip 9. The liquid film of the main fuel is atomized at the edge of the upstream atomization lip 9 by air currents flowing along the outer and the inner surface of the upstream atomization lip 9, and the atomized main fuel flows into the prevaporizing, premixing chamber 10.

If the combustor to which the premixed air-fuel mixture supply device supplies the premixed air-fuel mixture is in a high-load operation, the main fuel is injected into high-temperature air currents. Consequently, the main fuel is evaporated and mixed with air currents in the prevaporizing, premixing chamber 10 to produce a lean premixed air-fuel mixture, and the lean premixed air-fuel flows into a combustion chamber 15 for lean burn.

If the combustor to which the premixed air-fuel mixture supply device supplies the premixed air-fuel mixture is in a low-load operation, the main fuel is injected at a low velocity into low-temperature air currents. Consequently, the quantity of the main fuel that impinges on the upstream atomization lip 9 is small, and some part of the injected main fuel flows downstream without evaporating in the prevaporizing, premixing chamber 10 because the temperature of the air currents is low, for example 200° C. or below. The main fuel not vaporized is carried by the swirling air currents and is caused to adhere to the outer wall of the prevaporizing, premixing chamber 10 by centrifugal force, and flows downstream in a liquid film. The liquid film of the main fuel is atomized at the edge of the downstream atomization lip 14 by air currents flowing along the outer and the inner surface of the downstream atomization lip 14. The main fuel is thus evaporated, atomized and mixed with air currents in the prevaporizing, premixing chamber 10 to produce a premixed air-fuel mixture, and the premixed air-fuel mixture flows into the combustion chamber 15. While the combustor is in a low-load operation, the premixed air-fuel mixture burns in a diffusive combustion mode instead of in a lean-burn mode. However, the mode of combustion of the premixed air-fuel mixture produced and supplied by the premixed air-fuel mixture supply device of the present invention is far better than that of combustion of a premixed air-fuel mixture produced and supplied by a premixed air-fuel supply device not provided with any air passage corresponding to the secondary air passage 11 and any member corresponding to the downstream atomization lip 14. Diffusive combustion during the low-load operation improves flame stability.

The difference between the premixed air-fuel mixture supply devices in the first and the second embodiment will be comparatively described with reference to FIGS. 1 and 2. The fuel atomized by the edge of the downstream atomization lip 14 of the first embodiment shown in FIG. 1 tends to diverge more widely than the fuel atomized by the edge of the downstream atomization lip 14 of the second embodiment shown in FIG. 2. If the swirling direction of swirling air currents produced by the swirling device 8*a* and 8*b*, and the swirling direction of swirling air currents produced by the swirling device 12 are the same, the dispersion of the fuel injected through the fuel injecting holes 7 is suppressed, the fuel cannot be satisfactorily mixed with air, different parts of the air-fuel mixture have different local fuel concentrations, flame stability is improved particularly in the low-load operation, the swirling force of the air-fuel mixture at the exit of the prevaporizing, premixing chamber 10 is high, and the expansion of a reverse flow region in the combustion chamber 15 further improves flame stability, whereas the $NO_x$ reducing performance of the premixed air-fuel mixture supply device deteriorates to some extent. If the swirling direction of swirling air currents produced by the swirling device 8*a* and 8*b*, and the swirling direction of swirling air currents produced by the swirling device 12 are opposite to each other, the fuel is dispersed satisfactorily, the premixed air-fuel mixture supply device assumes contrastive characteristics; that is, flame stability deteriorates and the $NO_x$ decreasing performance of the premixed air-fuel mixture supply device is improved.

The sectional area of the secondary air passage 11 will be explained. Whereas the effect of air currents on atomizing the fluid at the edge of the downstream atomization lip 14 increases with increase in the sectional area of the secondary air passage 11, the flow rate of air that flows through air passages 4*a* and 4*b* decreases. Such a phenomenon due to increase in the sectional area of the secondary air passage 11 decreases the air-to-fuel ratio of the premixed air-fuel mixture at the end of the prevaporizing, premixing chamber 10 while the combustor is in a high-load operation, which has a negative effect on reduction of $NO_x$. Suppose that the air passages 4*a*, 4*b* and 11 have sectional areas 4*as*, 4*bs* and 11*s*, respectively. Then, it is desirable that the ratio: $\mathbf{11}s/(\mathbf{4}as+\mathbf{4}bs+\mathbf{11}a)$ is between 5% and 10%. If the reduction of $NO_x$ while the combustor is in a high-load operation is important, the ratio: $\mathbf{11}s/(\mathbf{4}as+\mathbf{4}bs+\mathbf{11}s)$ is between 2% and 5% to produce a lean premixed air-fuel mixture.

The atomization effect of the air currents flowing through the secondary air passage 11 is satisfactory when the velocity of the air currents is high. Since the maximum velocity of the air currents is dependent on the pressure difference between the exterior and the interior of the liner, it is desirable that the velocity of the air currents is equal to or not lower than the velocity of air currents injected from the prevaporizing, premixing chamber 10.

Although the tail part of the atomization lip is formed in a small thickness and the edge of the tail part is rounded in most cases, it is also effective in satisfactorily atomizing the fuel to sharpen the edge of the tail part, or to cut the edge of the tail part perpendicularly to the outer and the inner surface of the tail part of the atomization lip. When the edge of the tail part is cut perpendicularly to the outer and the inner surface of the tail part, the sectional area of the air passage increases sharply at the edge of the atomization lip. Such a sudden increase in the sectional area of the air passage disturbs the air currents around the edge of the atomization lip or produces small eddies, promoting the atomization of the fuel. In the premixed air-fuel mixture supply devices shown in FIGS. 1 and 2, the edge of the atomization lip is cut perpendicularly to the outer and the inner surface of the atomization lip. It is undesirable that the thickness t of the edge of the atomization lip is excessively big because the excessively thick edge of the atomization lip reduces the atomizing effect of air currents flowing along the outer surface of the atomization lip. Desirably, the thickness t is between 1 to 3 mm.

The accompanying drawings are conceptual views of the premixed air-fuel mixture supply devices not concretely showing the construction of the premixed air-fuel mixture supply devices. Although the swirling devices included in the premixed air-fuel mixture supply devices embodying the present invention are supposed to be axial swirling devices, the same may be radial swirling devices. Although the foregoing premixed air-fuel mixture supply devices are supposed to have cylindrical shapes, the same may be formed in annular shapes.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A premixed air-fuel mixture supply device combined with a combustor liner included in a combustor, said premixed air-fuel mixture supply device comprising:

a prevaporizing, premixing unit having inner and outer walls defining a prevaporizing, premixing chamber, the premixing chamber having a main combustion air passage for a premixed air-fuel mixture and the main combustion air passage being located outside of a pilot combustion air passage for a pilot fuel; and a wall surrounding an end part of the outer wall so as to define a secondary combustion air passage together with the end part of the outer wall around the prevaporizing, premixing chamber;

wherein a tail part of the outer wall is shaped in an atomization lip.

2. The premixed air-fuel mixture supply device according to claim 1 further comprising a swirl device disposed in the secondary combustion air passage.

3. The premixed air-fuel mixture supply device according to claim 1, wherein the atomization lip is formed such that a tail part thereof lies at or near an exit of the prevaporizing, premixing chamber.

4. The premixed air-fuel mixture supply device according to claim 1, wherein an extremity of the tail part of the atomization lip is formed in a sharp edge.

5. The premixed air-fuel mixture supply device according to claim 1, wherein an extremity of the tail part of the atomization lip is cut perpendicularly or substantially perpendicularly to the flowing direction of the combustion air.

6. The premixed air-fuel mixture supply device according to claim 1, wherein an extremity of the tail part of the atomization lip is cut perpendicularly or substantially perpendicularly to the flowing direction of the combustion air, and the extremity of the tail part of the atomization lip has a thickness between 1 to 3 mm.

7. The premixed air-fuel mixture supply device according to claim 1, wherein the secondary combustion air passage is formed around the prevaporizing, premixing chamber, and a sectional area of the secondary combustion air passage is 5% or below of a total sectional area of the prevaporizing, premixing chamber and the secondary combustion air passage.

8. The premixed air-fuel mixture supply device according to claim 1, wherein the secondary combustion air passage is formed around the prevaporizing, premixing chamber, and a sectional area of the secondary combustion air passage is 5 to 10% of a total sectional area of the prevaporizing, premixing chamber and the secondary combustion air passage.

9. The premixed air-fuel mixture supply device according to claim 1, wherein the secondary air passage is formed around the prevaporizing, premixing chamber, and thickness of the atomization lip formed in the tail part of the inner wall defining the secondary combustion air passage decreases in the flowing direction of combustion air so that an inside diameter of the atomization lip increases gradually in the flowing direction of combustion air.

10. The premixed air-fuel mixture supply device according to claim 1, wherein the secondary combustion air passage is formed around the prevaporizing, premixing chamber, and thickness of the atomization lip formed in the tail part of the inner wall defining the secondary combustion air passage decreases in the flowing direction of combustion air so that the outside diameter of the atomization lip decreases gradually in the flowing direction of the combustion air.

11. The premixed air-fuel mixture supply device according to claim 1, wherein the secondary combustion air passage is formed around the prevaporizing, premixing chamber, the swirling device disposed in the secondary combustion air passage swirls combustion air flowing through the secondary combustion air passage in one direction, and swirling devices disposed in an inner passage swirl combustion air flowing through the inner passage in the same direction.

12. The premixed air-fuel mixture supply device according to claim 1, wherein the secondary combustion air passage is formed around the prevaporizing, premixing chamber, the swirling device disposed in the secondary combustion air passage swirls combustion air flowing through the secondary combustion air passage in one direction, and swirling devices disposed in an inner passage swirl combustion air flowing through the inner passage in a direction opposite the direction in which the swirling device disposed in the secondary combustion air passage swirls the combustion air flowing through the secondary air passage.

13. The premixed air-fuel mixture supply device according to claim 1, wherein the prevaporizing, premixing unit injects the fuel in a direction substantially the same as the flowing direction of combustion air.

14. The premixed air-fuel mixture supply device according to claim 1, wherein the secondary combustion air passage is formed around the prevaporizing, premixing chamber, and velocity of combustion air at the exit of the secondary combustion air passage is equal to or not lower than velocity of air flowing through the inner passage.

* * * * *